US005966569A

United States Patent [19]

Haneda

[11] Patent Number: 5,966,569

[45] Date of Patent: Oct. 12, 1999

[54] IMAGE FORMING APPARATUS WHICH INCLUDES SPURRED WHEELS PROVIDED ON A CONVEYANCE SECTION IN A MANNER WHICH MAKES JAM CLEARANCE EASY AND WHICH AVOIDS DAMAGE TO BOTH THE APPARATUS AND AN OPERATOR'S HANDS

[75] Inventor: Satoshi Haneda, Hachioji, Japan

[73] Assignee: Konica Corporation, Tokyo, Japan

[21] Appl. No.: 08/988,461

[22] Filed: Dec. 10, 1997

[30] Foreign Application Priority Data

Dec. 16, 1996 [JP] Japan ..... 8-335769

[51] Int. Cl.[6] ..... G03G 15/00; G03G 21/16

[52] U.S. Cl. ..... 399/121; 399/124; 399/125; 399/397; 399/400

[58] Field of Search ..... 399/121, 124, 399/125, 298, 302, 309, 397, 400

[56] References Cited

U.S. PATENT DOCUMENTS

| | | | |
|---|---|---|---|
| 5,027,159 | 6/1991 | Oda et al. | 399/309 |
| 5,159,392 | 10/1992 | Kasahara et al. | 399/309 |
| 5,291,256 | 3/1994 | Kitajima et al. | 399/124 X |
| 5,758,243 | 5/1998 | Haneda et al. | 399/298 |
| 5,826,143 | 10/1998 | Haneda et al. | 399/309 X |

FOREIGN PATENT DOCUMENTS

| | | |
|---|---|---|
| 49-37538 | 10/1974 | Japan . |
| 54-28740 | 9/1979 | Japan . |
| 1-44457 | 2/1989 | Japan . |
| 4-214576 | 8/1992 | Japan . |

*Primary Examiner*—William Royer

*Attorney, Agent, or Firm*—Frishauf, Holtz, Goodman, Langer & Chick, P.C.

[57] ABSTRACT

An image forming apparatus includes an image forming body for carrying thereon a toner image, and a belt-shaped intermediate transfer body for carrying thereon the toner image transferred from the image forming body. A first transfer device is provided for transferring another toner image carried by the image forming body onto an obverse side of a recording sheet conveyed by the intermediate transfer body, and a second transfer device is provided for transferring the toner image carried on the intermediate transfer body onto a reverse side of the recording sheet. In addition, a fixing device is provided for fixing the toner images transferred on both sides of the recording sheet which is separated from the intermediate transfer body, and a conveyor portion having spurred wheels is provided between the intermediate transfer body and the fixing device for conveying the transfer member to the fixing device. The apparatus has a structure including two frames which can be opened. When the frames are closed, the image forming body is set to a first position adjacent to and facing the intermediate transfer body and the second transfer device is set to a second position adjacent to the intermediate transfer body and the conveyor portion, and when the frames are opened, the image forming body is apart from the first position and the second transfer device is apart from the second position.

14 Claims, 11 Drawing Sheets

FIG. 8 ( A )
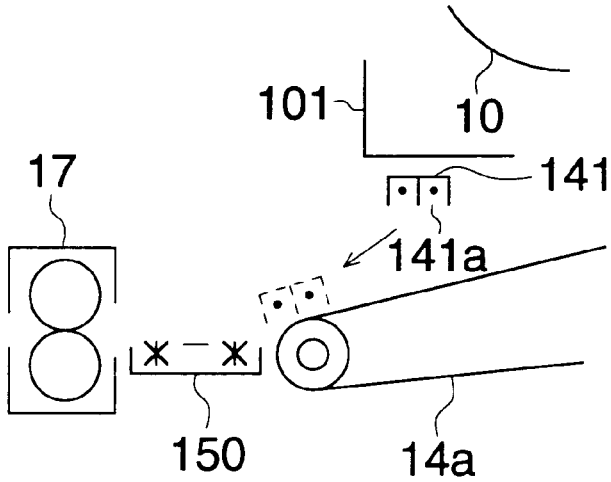
FIG. 8 ( B )
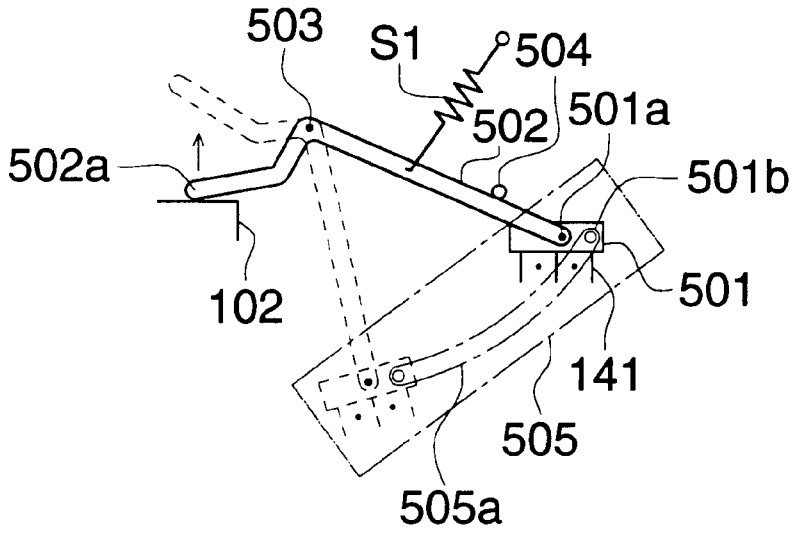

FIG. 13 ( A )
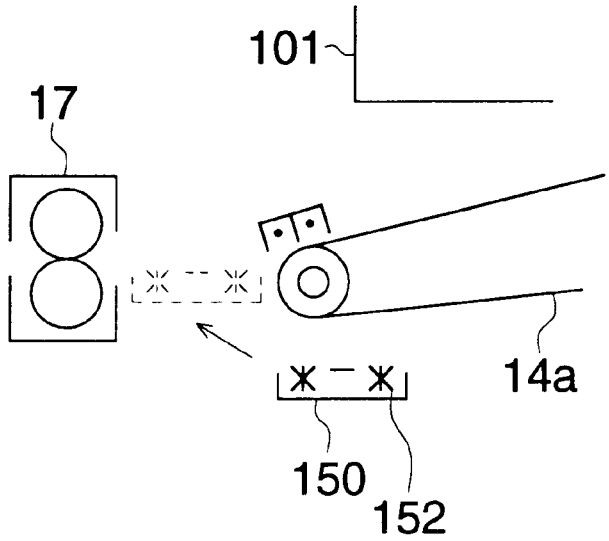
FIG. 13 ( B )
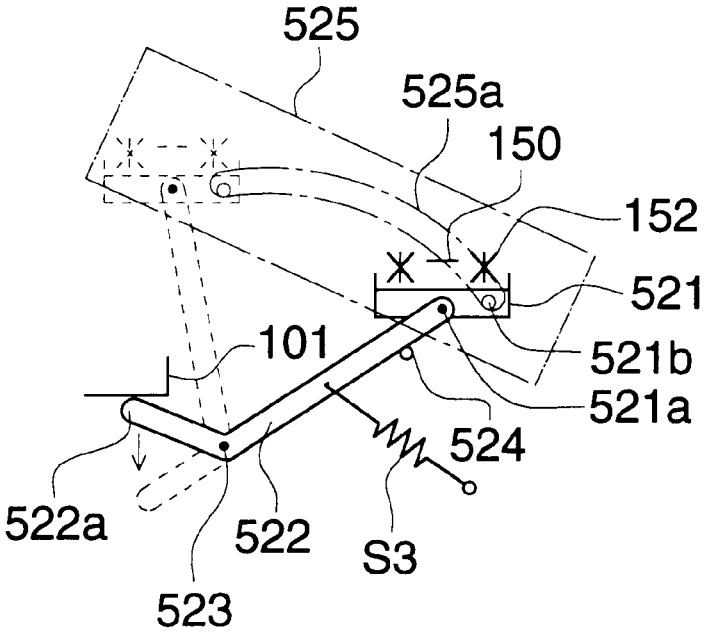

IMAGE FORMING APPARATUS WHICH INCLUDES SPURRED WHEELS PROVIDED ON A CONVEYANCE SECTION IN A MANNER WHICH MAKES JAM CLEARANCE EASY AND WHICH AVOIDS DAMAGE TO BOTH THE APPARATUS AND AN OPERATOR'S HANDS

BACKGROUND OF THE INVENTION

The present invention relates to an image forming apparatus of an electrophotographic system such as a copying machine, a printer and a facsimile telegraph, wherein a charging means, an imagewise exposure means and a developing means are arranged around an image forming body, and a toner image formed on an image carrier is transferred onto a transfer member (hereinafter referred to as a recording sheet) and fixed thereon.

For two-sided copying in the past, an image for one side formed on an image forming body is first transferred onto a recording sheet and fixed thereon, and the recording sheet is stored temporarily in reversing/sheet-feeding unit, and then is fed from the reversing/sheet-feeding unit in a synchronization with an image formed again on the image forming body so that the image for the other side is transferred onto the recording sheet and fixed thereon.

In the two-sided copying apparatus, a recording sheet is fed to a reversing/sheet-feeding unit and is passed through a fixing unit twice. Therefore, reliability of conveyance of the recording sheet has been low, resulting in a cause for jamming. In contrast to this, Japanese TOKKOSHO Nos. 49-37538 and 54-28740 and TOKKAIHEI Nos. 1-44457 and 4-214576 disclose a technology wherein toner images are formed on both sides of a recording sheet and then are fixed collectively on the recording sheet. In each of TOKKAIHEI Nos. 1-44457 and 4-214576, in particular, there is disclosed a method wherein a plurality of toner image receiving bodies each being composed of an image forming body, a charging means, an imagewise exposure means and a developing means are arranged in parallel on a toner image receiving body so that a two-sided copy of color images may be formed.

In the two-sided color image forming proposed by TOKKAIHEI Nos. 1-44457 and 4-214576, however, image deteriorations such as doubling, toner scattering and frictional damage tend to be caused because color toner images each being different in color are superimposed on an intermediate transfer body, although conveyance of a recording sheet is improved.

In contrast to this, the inventors of the present invention have studied a two-sided image forming apparatus wherein toner images formed on an image forming body are collectively transferred onto a belt-shaped intermediate transfer body (toner image receiving body) temporarily, then toner images are formed on the image forming body again, and the toner images on the toner image receiving body and the toner images formed again on the image forming body are transferred respectively onto both sides of a recording sheet (a transfer member). However, it is not easy to clear jamming of the recording sheet in the sheet feeding path between the image forming body and the belt-shaped toner image receiving body. For easy jam clearance, therefore, the inventors have studied the structure wherein an apparatus is divided into an upper shell and a lower shell with a sheet-feeding path between, in which, however, a transfer-separating means provided to face a toner image receiving body obstructs jam clearance at the edge on the part of a fixing means, causing a problem that the transfer-separating means is damaged, and, in particular, a discharging electrode provided on the transfer-separating means is damaged.

The inventors have also studied that a conveyance section with spurred wheels which is provided between a toner image receiving body and a fixing means so that a recording sheet having on its both sides toner images formed may by conveyed without suffering damage of the toner images from the toner image receiving body to the fixing means. However, there still is a problem in that the spurred wheels may be damaged in the course of jam clearance or in that the spurred wheels can hurt human hands.

SUMMARY OF THE INVENTION

An object of the invention is to solve the problems mentioned above and to provide an image forming apparatus wherein jam clearance is easy and a transfer-separating means and spurred wheels provided on a conveyance section are not damaged in the course of jam clearance, and the spurred wheels do not hurt human hands.

The above-mentioned object is attained by an image forming apparatus having therein an image forming body carrying a toner image formed by a toner image forming means, a belt-shaped intermediate transfer body onto which the toner image carried by the image forming body is transferred and carries the transferred toner image on its surface, a first transfer means which transfers a toner image carried by the image forming body onto the obverse side of a recording sheet conveyed by the intermediate transfer means, a second transfer means which transfers a toner image carried by the intermediate transfer body onto the reverse side of the recording sheet, and a fixing means which fixes toner images transferred onto both sides of the recording sheet separated from the intermediate transfer body, wherein the image forming apparatus is of an openable clamshell type, and when the image forming apparatus is in its opened state, the second transfer means is retracted from the position where it faces the intermediate transfer body, while when the image forming apparatus is in its closed state, the second transfer means approaches the intermediate transfer body to be set at the position where the second transfer means faces the intermediate transfer body.

The above-mentioned object is attained by an image forming apparatus having therein an image forming body carrying a toner image formed by a toner image forming means, a belt-shaped intermediate transfer body onto which the toner image carried by the image forming body is transferred and carries the transferred toner image on its surface, a first transfer means which transfers a toner image carried by the image forming body onto the obverse side of a recording sheet conveyed by the intermediate transfer means, a second transfer means which transfers a toner image carried by the intermediate transfer body onto the reverse side of the recording sheet, and a fixing means which fixes toner images transferred onto both sides of the recording sheet separated from the intermediate transfer body, wherein a conveyance section with spurred wheels which conveys the recording sheet toward the fixing means through a space between the intermediate transfer body and the fixing means is provided, the image forming apparatus is of an openable clamshell type composed of an upper shell and a lower shell, in which the upper shell is provided with the image forming body and the lower shell is provided with the intermediate transfer body and the fixing means, thereby the upper shell is made to be openable along a recording sheet conveyance path formed by both the image forming body and the intermediate transfer body, and the conveyance section is retracted from the position between the intermediate transfer body and the fixing means when the upper shell is in its open state, while the conveyance section is located and set between the intermediate transfer body and the fixing means when the upper shell is in its closed state.

The above-mentioned object is attained by an image forming apparatus having therein an image forming body carrying a toner image formed by a toner image forming means, a belt-shaped intermediate transfer body onto which the toner image carried by the image forming body is transferred and carries the transferred toner image on its surface, a first transfer means which transfers a toner image carried by the image forming body onto the obverse side of a recording sheet conveyed by the intermediate transfer means, a second transfer means which transfers a toner image carried by the intermediate transfer body onto the reverse side of the recording sheet, and a fixing means which fixes toner images transferred onto both sides of the recording sheet separated from the intermediate transfer body, wherein a conveyance section with spurred wheels which conveys the recording sheet toward the fixing means through a space between the intermediate transfer body and the fixing means is provided, the image forming apparatus is made to be capable of opening along a recording sheet conveyance path formed by the image forming body and the intermediate transfer body, and the conveyance section and the second transfer means move to be away from the conveyance path each other when the image forming apparatus is opened.

Each of FIGS. 8(A) and 8(B) is a diagram showing the first example wherein a transfer-separating means is arranged on a part of an image forming body.

Figure 9:
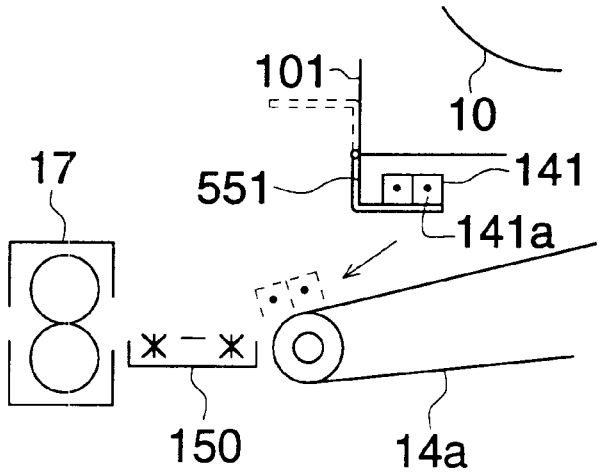

FIG. 9 is a diagram showing the second example wherein a transfer-separating means is arranged on a part of an image forming body.

Figure 10:
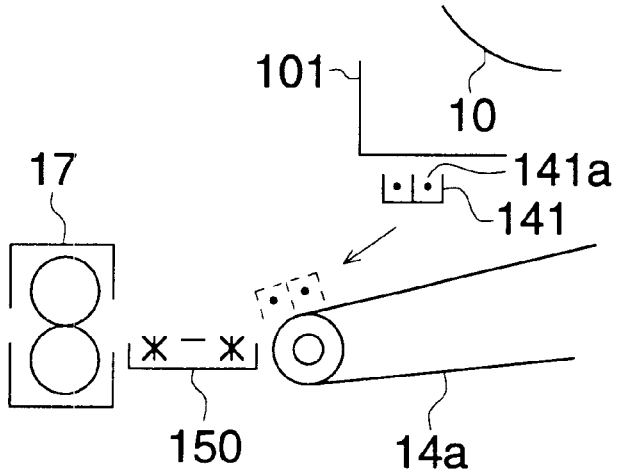

FIG. 10 is a diagram showing the third example wherein a transfer-separating means is arranged on a part of an image forming body.

FIGS. 11(A) and 11(B) are diagrams showing the first example wherein a transfer-separating means is arranged on a part of a fixing means.

Figure 12:
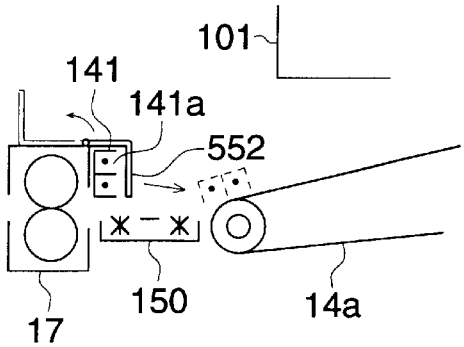

FIG. 12 is a diagram showing the second example wherein a transfer-separating means is arranged on a part of a fixing means.

Each of FIGS. 13(A) and 13(B) is a diagram showing the first example of an arrangement of a conveyance section.

Figure 14:
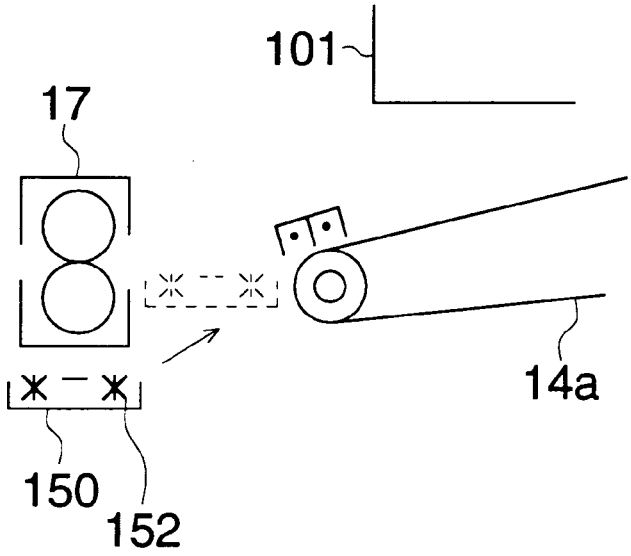

FIG. 14 is a diagram showing the second example of an arrangement of a conveyance section.

Figure 15:
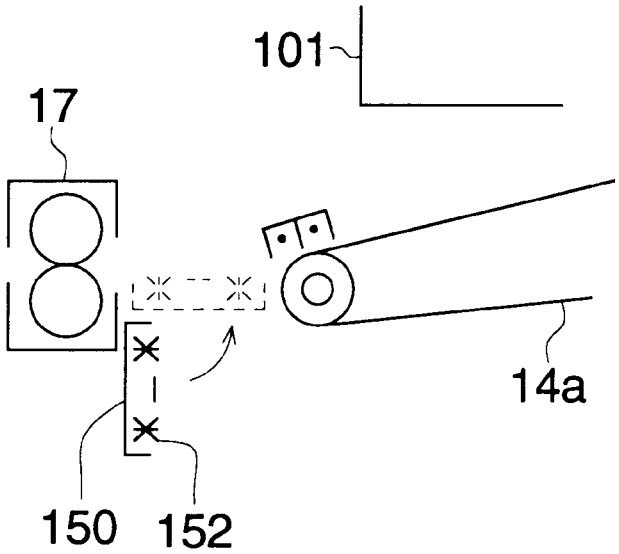

FIG. 15 is a diagram showing the third example of an arrangement of a conveyance section.

Figure 16:
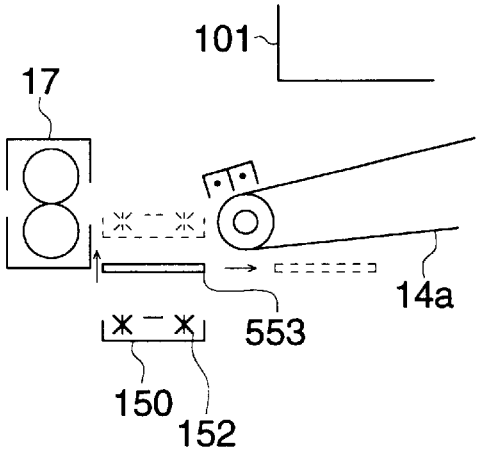

FIG. 16 is a diagram showing the fourth example of an arrangement of a conveyance section.

Figure 17:
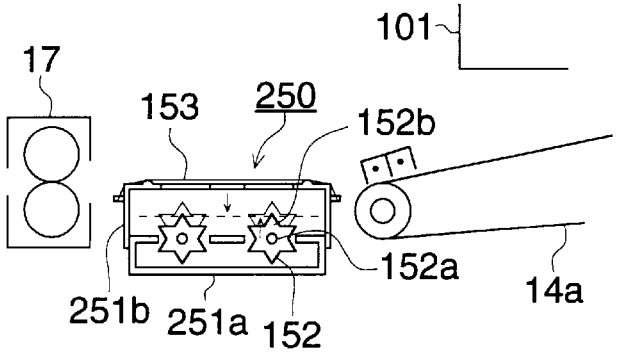

FIG. 17 is a diagram showing the first example of the space between a spurred wheel and a guide both provided on a conveyance section.

Figure 18:
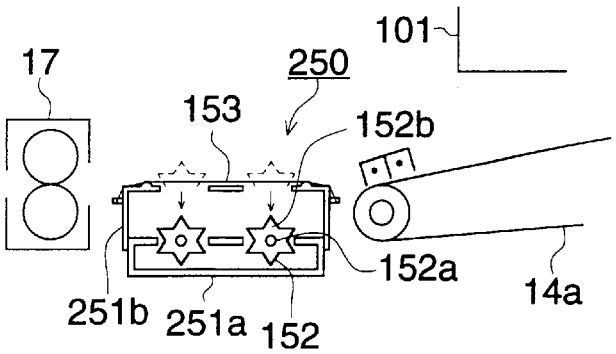

FIG. 18 is a diagram showing the second example of the space between a spurred wheel and a guide both provided on a conveyance section.

DETAILED DESCRIPTION OF THE PREFERRED EMBODIMENT

Embodiment of the invention

An embodiment of the invention will be explained as follows. In the explanation of the following embodiment, an obverse side image means an image transferred onto the surface of a recording sheet (the surface or the top side of the recording sheet) facing the image forming body in the transfer area when color toner images are transferred on the recording sheet, while a reverse side image means an image transferred onto the other side of the recording sheet (the reverse side or the bottom side of the recording sheet).

Figure 1:
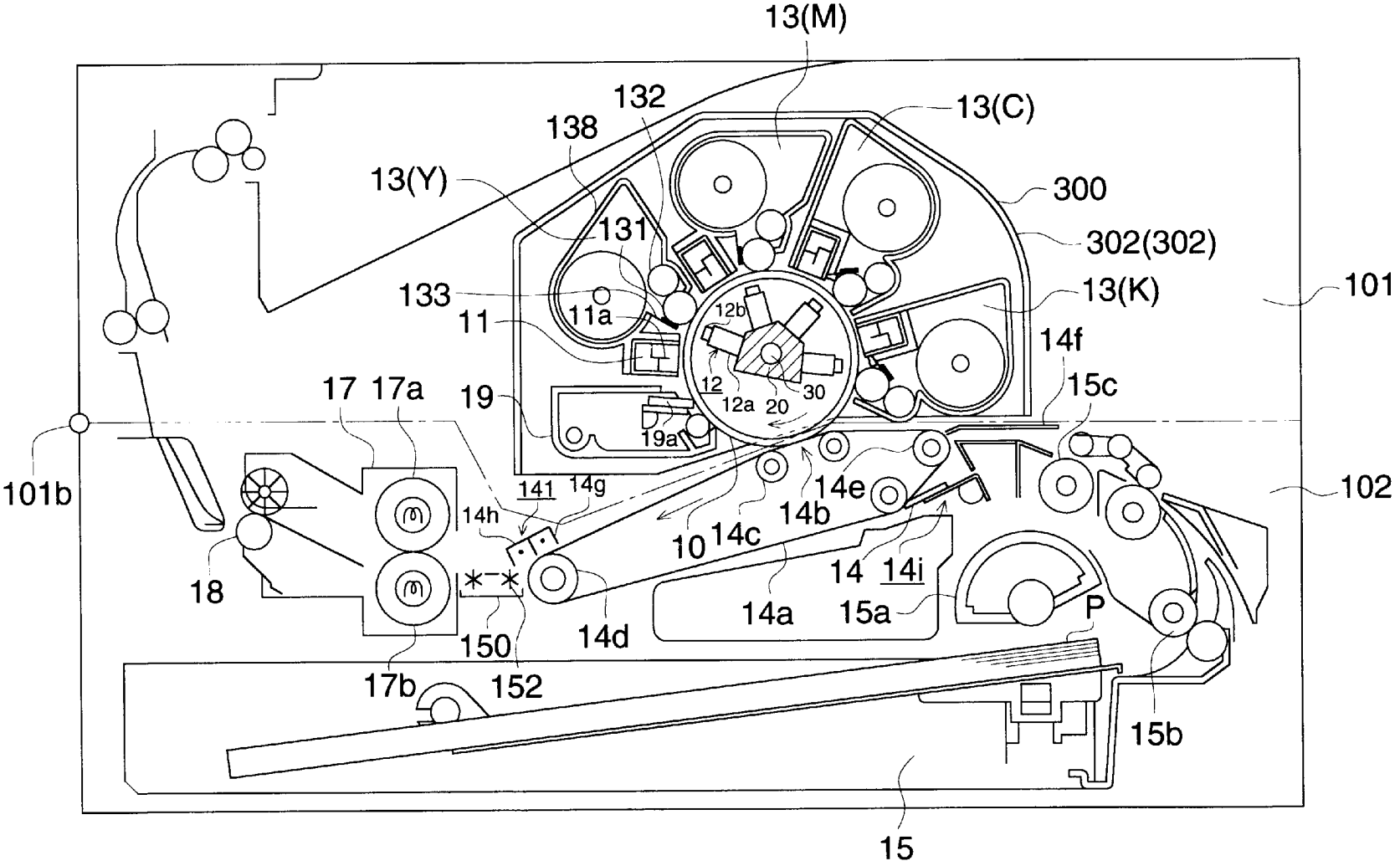
FIG. 1 is a sectional structure diagram of a color image forming apparatus showing an embodiment of the invention.
Figure 2:
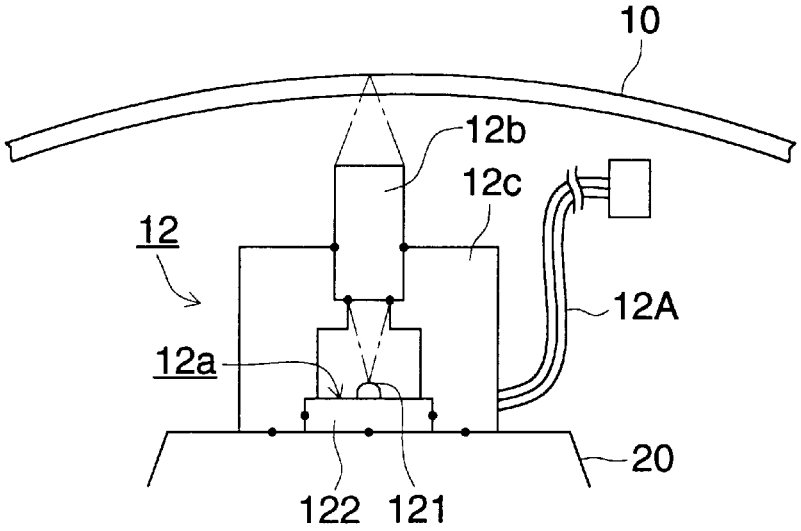
FIG. 2 is an enlarged section of primary portions of an imagewise exposure means in FIG. 1.
Figure 3:
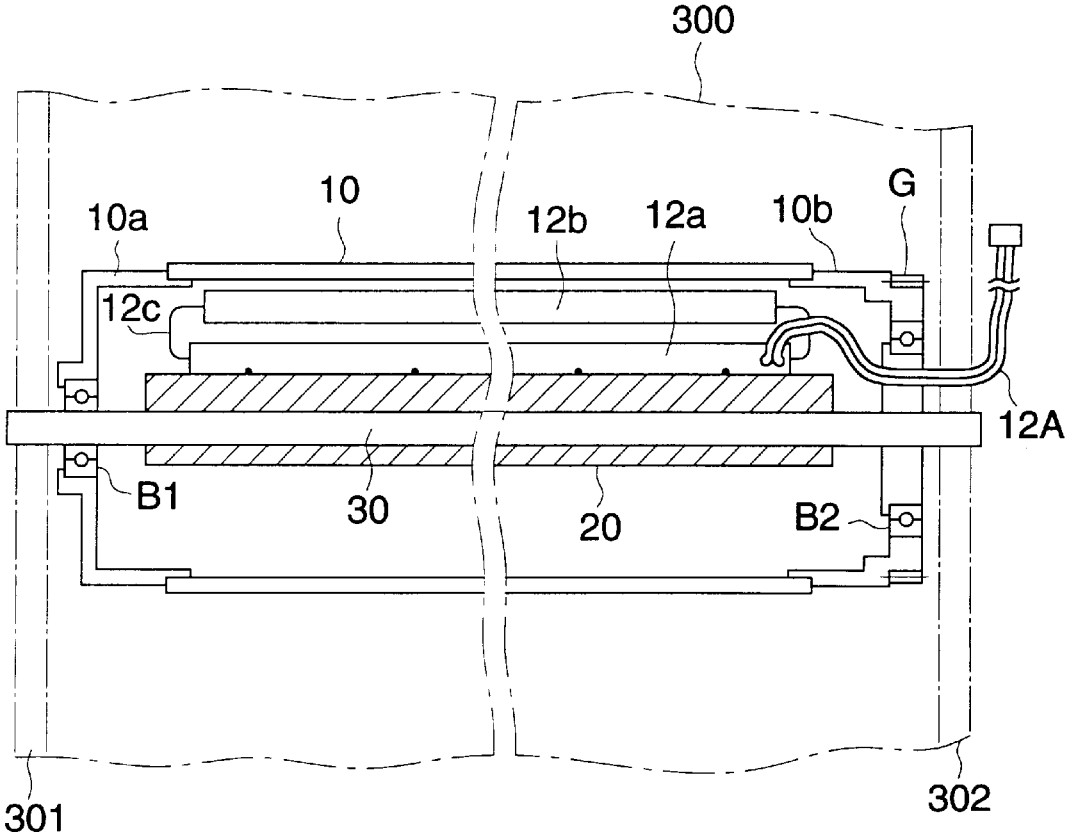
FIG. 3 is a side sectional view of an image forming body in FIG. 1.
Figure 4:
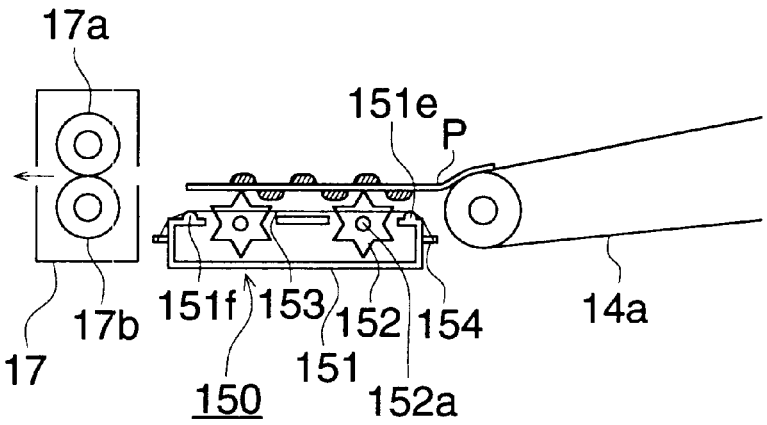
FIG. 4 is a diagram showing a conveyance section.
Figure 5:
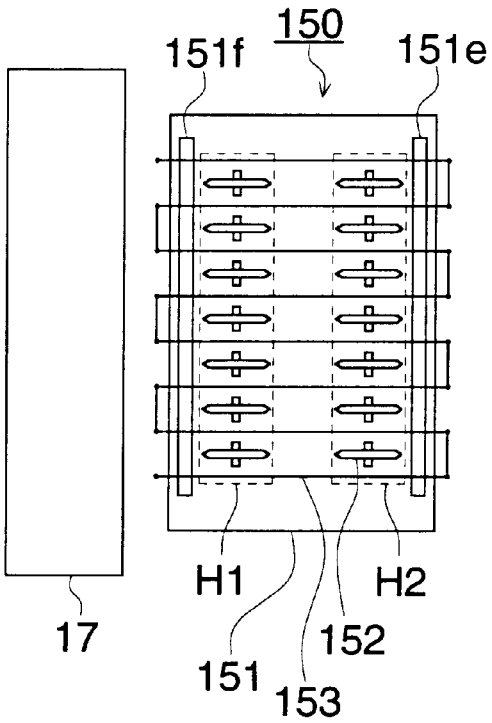
FIG. 5 is a top view of the conveyance section in FIG. 4.
Figure 6:
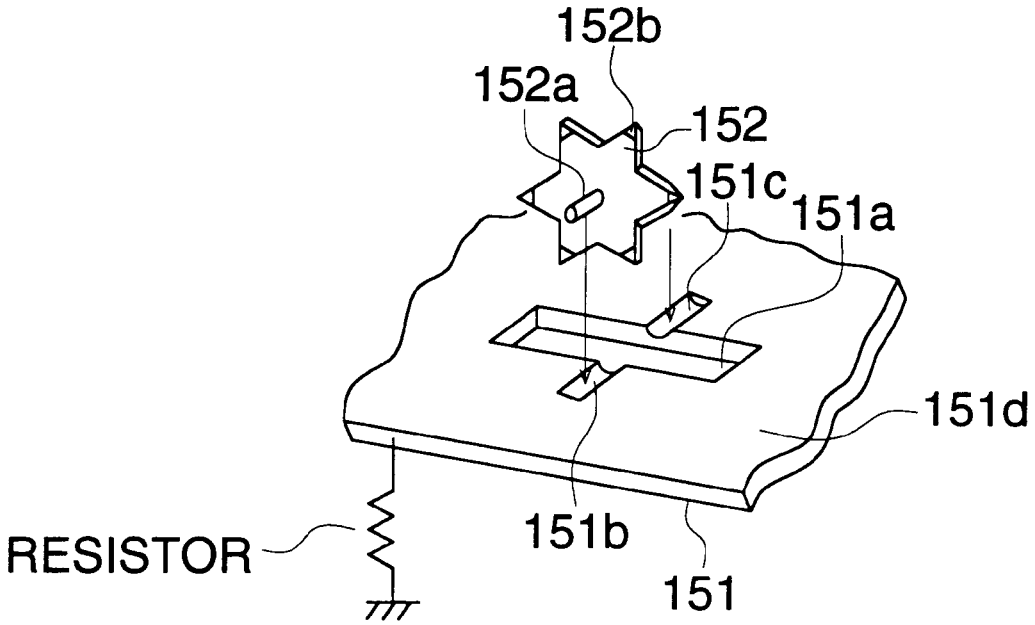
FIG. 6 is a perspective view of spurred wheels.
Figure 7:
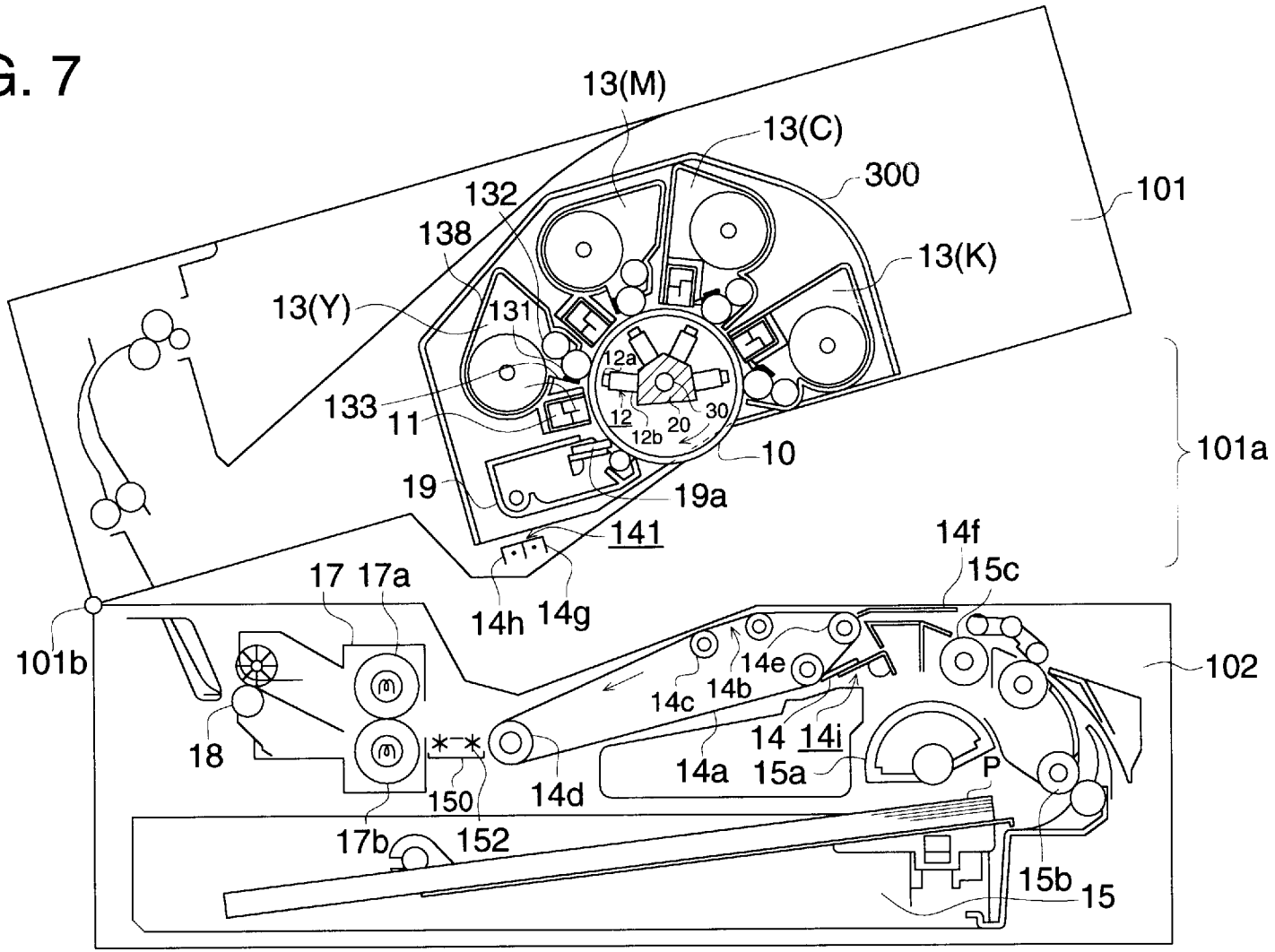
FIG. 7 is a diagram showing the opened upper shell in FIG. 1.

An image forming process and each structure in an embodiment of an image forming apparatus of the invention will be explained as follows, referring to FIGS. 1–7. FIG. 1 is a sectional structure diagram of a color image forming apparatus showing an embodiment of the invention and FIG. 2 is an enlarged section of primary portions of an imagewise exposure means in FIG. 1. FIG. 3 is a side sectional view of an image forming body in FIG. 1, FIG. 4 is a diagram showing a conveyance section, FIG. 5 is a top view of the conveyance section in FIG. 4, FIG. 6 is a perspective view of spurred wheels, and FIG. 7 is a diagram showing the opened upper shell in FIG. 1. The color image forming apparatus shown in FIG. 1 is provided with a belt-shaped transfer means, and is further a two-sided image forming apparatus wherein toner images are formed on both sides of a recording sheet by the use of a belt-shaped member and then the toner images are collectively fixed. However, the invention is not limited only to two-sided image forming.

FIGS. 1–3 show that photoreceptor drum 10 which is an image forming body is one that is provided inside thereof with a cylindrical base body formed with optical glass (trade name: Pyrex) or with transparent member such as transparent acrylic resin made through a centrifugal polymerization method, and is provided with a photoconductive layer such as a transparent conductive layer, an a-Si layer or an organic photoconductive layer, formed on the external circumferential surface of the base body, and the photoreceptor drum is rotated, under the condition that it is grounded, in the clockwise direction shown with an arrow mark in FIG. 1.

As shown in FIG. 3, the photoreceptor drum 10 is supported rotatably through flange members 10*a* and 10*b* at its both ends which engage with the photoreceptor drum 10 to fix it which are pivoted on supporting shaft 30 fixed on both side plates 301 and 302 of process unit 300 through bearings B1 and B2 embedded respectively in the flange members 10*a* and 10*b* on both ends, and it is rotated at a constant speed in the prescribed direction when gear G united with the flange member 10*b* solidly is engaged with a driving gear on the part of the apparatus main body to be driven.

Scorotron charging unit 11 serving as a charging means which is used for image forming for each color of yellow (Y), magenta (M), cyan (C) and black (K) is mounted to face the photoreceptor drum 10 in the direction perpendicular to the moving direction of the photoreceptor drum 10 which is an image forming body, and the scorotron charging unit is provided with a control grid kept at prescribed voltage against the above-mentioned organic photoconductive layer of the photoreceptor drum 10 and with discharge electrode 11*a* composed, for example, of a serrated electrode to conduct a charging operation (negative charging in the present embodiment) through corona discharging with polarity identical to that of toner, and thereby to give uniform voltage to the photoreceptor drum 10. As discharge electrode 11*a*, a wire electrode and an acicular electrode can also be used in addition to the foregoing.

Exposure optical system 12 serving as an imagewise exposure means for each color is arranged in a way that an exposure position on the photoreceptor drum 10 is located between the discharge electrode 11*a* of the scorotron charging unit 11 and a developing position of developing unit 13.

Exposure optical system 12 serving as an imagewise exposure means for each color of Y, M, C and K is structured as a unit wherein line-shaped exposure element 12*a* includes LEDs (light-emitting diode) 121 arranged in an array. The LED's serve as plural light-emitting elements arranged as an exposure system on base plate 122 in the primary scanning direction that is parallel with an axis of the photoreceptor drum 10. The exposure element 12*a* is mounted on lens holder 12*c* serving as a focusing element holding member that holds a light-converging light transmitter (trade name: SELFOC lens) 12*b* serving as a focusing element. For example, exposure element 12*a* and SELFOC lens 12*b* are fixed on lens holder 12*c* with adhesives shown with black circle in FIG. 2. Further, exposure optical system 12 is fixed on supporting member 20 serving as a common supporting body that supports each exposure optical system 12 with adhesives shown with black circle in FIG. 2 or FIG. 3, for example, and then is housed in the base body of the photoreceptor drum 10.

Exposure optical system 12 for each color is fixed temporarily on supporting member 20 directly without using a wedge-shaped sticking member used in the past, and then is directly fixed with adhesives shown with black circle in FIG. 2 on the supporting member 20 serving as a common supporting body for exposure optical system 12 for each color, after being adjusted by jigs and tools in advance to the state in which the primary scanning direction with the photoreceptor drum 10 and the sub-scanning direction of the rotary direction of the photoreceptor drum 10 can be positioned. Due to this, supporting member 20 that is provided with exposure optical system 12 can be made small. Namely, an imagewise exposure means can be made small.

Further, lead wire 12A is led out of an end of base plate 122 of LED 121, and then is led out of exposure optical system 12 along a side wall of lens holder 12*c*. Since the lead wire 12A is led out of an end of the base plate 122 along the side wall of the lens holder 12*c*, exposure optical system 12 can be mounted in a narrow space, which further makes an imagewise exposure means to be small.

Image data for each color inputted by a separate image scanner through reading or inputted with external signals and stored in an unillustrated section such as RAM, for example, are successively read out from a storage section through the control section of the apparatus main body, and then are inputted as electric signals into exposure optical system 12 for each color through the lead wire 12A, thus, LED 121 is lit by pulse width modulation system (PWM system), for example. A wavelength of light emitted from a light-emitting element used in the present embodiment is within a range of 600–900 nm.

As the aforesaid exposure element, a plurality of light-emitting elements arranged in array represented by FL (fluorescent substance luminescence), EL (electroluminescence) and PL (plasma discharge) are used in addition to the foregoing. With regard to the wavelength of light of the light-emitting element used in the present embodiment, a wavelength ranging from 780 nm to 900 nm which has high transmissivity for Y toner, M toner and C toner is usually used when imagewise exposure is conducted from the outside. However, a wavelength ranging from 400 nm to 780 nm which is shorter than the above wavelength and does not have transmissivity for color toner sufficiently can be used because of the system to conduct imagewise exposure from the reverse side.

With regard to an order of colors for image forming and developing units 13 provided, in accordance with the order of colors, around photoreceptor drum 10 that is rotated, developing units 13 for Y and M are arranged on the left side of the photoreceptor drum 10 in FIG. 1, and developing units 13 for C and K are arranged on the right side of the photoreceptor drum 10 in the present embodiment, and scorotron charging unit 11 for Y and M is arranged under development casing 138 for developing units 13 for Y and M, while, scorotron charging unit 11 for C and K is arranged above development casing 138 for developing units 13 for C and K.

Developing unit 13 representing a developing means for each color contains mono-component developing agent for each of yellow (Y), magenta (M), cyan (C) and black (K), and is provided with developing sleeve 131 formed with a cylindrical and non-magnetic stainless steel or aluminum material having a thickness of 0.3 mm–0.5 mm and an outside diameter of 10–20 mm which rotates in the same direction as that of the photoreceptor drum 10 at a developing area while keeping a prescribed distance from the circumferential surface of the photoreceptor drum 10.

The developing sleeve 131 is a developing agent carrier which is made of non-magnetic material such as aluminum or stainless steel, for example, and is supported rotatably with its surface subjected to roughening processing by sandblasting to be 0.5 $\mu$m–5 $\mu$m in indication (JIS-B0610) by JIS 10-point average roughness. The developing sleeve 131 rotates in the same direction as that of the photoreceptor drum 10 at the developing area while keeping a prescribed distance from the circumferential surface of the photoreceptor drum 10.

The numeral 132 is a supply roller made of sponge or urethane rubber foam material, for example, and being provided in parallel with the developing sleeve 131 at the supplying section to rotate in the same direction as that of the developing sleeve 131. The numeral 133 is a regulating member which is provided to regulate a height and an amount of a developing agent layer(toner layer), and it is structured by a belt-shaped elastic plate made of plate-shaped stainless steel or rubber material, for example, and by a belt-shaped elastic body that is provided at the location where it comes in contact with the developing sleeve 131, with the elastic body supplying developing agent (toner) to the developing sleeve 131 at the tip portion of the elastic plate. The elastic body is made of sponge or urethane rubber foam material, for example. The regulating member 133 is arranged with its tip portion pointing toward the upstream side in the rotary direction of the developing sleeve 131.

The developing unit 13 is kept by a stopper roll to be in non-contact with the photoreceptor drum 10 with a clearance of a prescribed value of 100 $\mu$m–500 $\mu$m, for example, from the photoreceptor drum 10, and when developing with developing unit 13 for each color, a developing bias voltage of DC voltage or of DC voltage plus AC voltage is impressed on developing sleeve 131 to conduct jumping development with mono-component developing agent contained in the developing unit, and a DC bias voltage with polarity identical to that of toner (negative polarity in the present embodiment) is impressed on the photoreceptor drum 10 with negative charges to conduct non-contact reversal development which sticks toner on the exposed portion. Accuracy of the clearance for development in this case needs to be about 20 μm or less for preventing image unevenness.

The developing unit 13 for each color conducts reversal development for an electrostatic latent image formed on the photoreceptor drum 10 through charging conducted by the scorotron charging unit 11 and through imagewise exposure conducted by exposure optical system 12, by means of a non-contact developing method with an impressed developing bias voltage under the non-contact condition with toner having polarity identical to that in charging (toner with negative polarity in the present embodiment, because of the negatively charged photoreceptor drum in the present embodiment).

As a mono-component developing agent (toner) used in the developing unit mentioned above, spherical or amorphous nonmagnetic toner obtained through the same method as in the conventional toner can be used. Preferable toner includes one composed of particles having an average particle size of not more than 20 μm, preferably not more than 10 μm, and especially preferably 1–7 μm which can be made by a method identical to the known method in prior art wherein resins such as a styrene type resin, a vinyl type resin, an ethylene type resin, a rosin-denatured resin, an acryl type resin, a polyamide resin, an epoxy resin, and a polyester resin, or resins of fatty acid wax such as palmitic acid and stearic acid are used, and a coloring component such as color dyes and charging control agent, when this is needed, are added to the aforesaid resins. Further, when necessary, lubricating agents for improving flow slide of particles and cleaning agents useful for cleaning the surface of an image forming body are mixed. As lubricating agents, colloidal silica, silicone varnish, metal soap or non-ion surfactant can be used, and as cleaning agents, surface active agents such as fatty acid metallic salt, organic-radical-substituted silicon or fluorine can be used.

Mono-component developing agent (toner) is sealed hermetically in developing unit 13, and when it is used up, a developing unit itself is replaced. Toner is subjected to triboelectrification between developing sleeve 131, regulating member 133 and supply roller 132.

As stated above, the use of a developing means employing mono-component developing agent makes developing unit 13 small, and arranging various members housed inside the developing unit used for the developing unit 13 around photoreceptor drum 10 radially from the center of the photoreceptor drum 10 makes the circumference of an image forming body to be used effectively, thus an apparatus portion around the image forming body can be made small.

An image read by an image-pickup element of an image reading apparatus which is separated from the main apparatus as an original image, or an image compiled by a computer is stored temporarily in a memory as image data for each color of Y, M, C and K.

The start of image recording makes an unillustrated photoreceptor driving motor to start for rotating photoreceptor drum 10 in the clockwise direction shown with an arrow mark in FIG. 1, and concurrently with this, charging operation of scorotron charging unit 11 for Y arranged under development casing 138 of developing unit 13 for yellow (Y) on the left side of the photoreceptor drum 10 starts applying voltage on the photoreceptor drum 10.

After applying of voltage on the photoreceptor drum 10, exposure thereon by means of electric signals corresponding to the first color signal, namely, image data for Y is started by exposure optical system 12 for Y, and thereby an electrostatic latent image corresponding to an image for Y among original images is formed on a photoconductive layer on the surface of the photoreceptor drum 10 through rotary scanning.

The latent image mentioned above is developed reversely by developing unit 13 for Y under the condition that developing agent on a developing sleeve is in non-contact, and thereby a toner image for yellow (Y) is formed in accordance with rotation of the photoreceptor drum 10.

Next, a charging operation of scorotron charging unit 11 for magenta (M) arranged at the left side of photoreceptor drum 10 and above yellow (Y) developing unit 13 and under development casing 138 of developing unit 13 for magenta (M) applies a voltage on the toner image for yellow (Y), thus, the photoreceptor drum 10 is exposed to the second color signals of exposure optical system 12 for M, namely, electric signals corresponding to image data for M, whereby, a toner image for magenta (M) is formed to be superimposed on the toner image for yellow (Y) by non-contact reversal development conducted by developing unit 13 for M.

Further, in the same process, a toner image for cyan (C) corresponding to the third color signals is formed to be superimposed by scorotron charging unit 11 arranged on the right side of photoreceptor drum 10 and above development casing 138 of developing unit 13 for cyan (C), exposure optical system 12 for cyan (C) and by developing unit 13 for cyan (C), and a toner image for black (K) corresponding to the fourth color signals is formed to be superimposed by scorotron charging unit 11 arranged on the right side of photoreceptor drum 10 and under cyan (C) and above development casing 138 of developing unit 13 for black (K), exposure optical system 12 and by developing unit 13, thus, a color toner image is formed on the circumferential surface of the photoreceptor drum 10 within a period of one turn of the photoreceptor drum 10.

Exposure to an organic photoconductive layer of the photoreceptor drum 10 conducted by exposure optical system 12 for Y, M, C and K is conducted from the inside of the photoreceptor drum 10 through the transparent base body stated above. Therefore, exposure of the image corresponding to the second, the third and the fourth color signals can be conducted without being affected by the toner image formed previously, and electrostatic latent images which are the same as the image corresponding to the first color signals can be formed.

Through the image forming process mentioned above, a superimposed color toner image which is to be a reverse side image is formed on photoreceptor drum 10 (image forming body) serving as an image forming body, and the superimposed color toner image representing the reverse side image is collectively transferred onto toner image receiving body **14*a* (intermediate transfer body) trained about driving roller 14*d* and driven roller 14*e* and provided to be adjacent to or in contact with the photoreceptor drum 10 by transfer unit 14*c* (first transfer means) on which DC voltage with polarity opposite to that of toner (positive polarity in the present embodiment) is applied, at transfer area 14*b***.

Toner remaining on photoreceptor drum 10 after transferring arrives at cleaning unit 19 where the toner is removed by cleaning blade **19*a* which is made of rubber material and is in contact with the photoreceptor drum 10**, so that color image forming for the succeeding obverse image may be conducted.

After the superimposed color toner image which is to be a reverse side image is formed on toner image receiving body 14*a* in the manner mentioned above, a superimposed toner image which is to be an obverse side image is formed in succession on the photoreceptor drum 10 in the same way as the aforesaid color image forming process. In this case, a reverse side image formed on the toner image receiving body 14*a* and an obverse side image formed on the photoreceptor drum 10 are synchronized at the transfer area 14*b* to be ready for two-sided toner image formation. Incidentally, it is necessary to change image data so that the obverse side image formed in this case may be on the mirror image relation with reverse side image formation on the photoreceptor drum 10.

Recording sheet P is fed out of sheet-feeding cassette 15 which is a recording sheet housing means by feed-out roller 15*a*, and fed by feeding roller 15*b* to be conveyed to timing roller 15*c*.

The recording sheet P is driven by the timing roller 15*c* to be fed to transfer area 14*b*, when a color toner image representing an obverse side image held on the photoreceptor drum 10 and a color toner image representing a reverse side image held on toner image receiving body 14*a* are synchronized. In this case, the recording sheet P is charged by sheet charging unit 14*f* to be in the same polarity as that of toner, then attracted to the toner image receiving body 14*a*, and fed to the transfer area 14*b*. Sheet-charging to the same polarity as that of toner prevents the recording sheet P from attracting a toner image on the toner image receiving body 14*a* and a toner image on the photoreceptor drum 10 in the area other than the transfer area, and thereby prevents disturbance of the toner image. As a recording sheet charging means, it is also possible to use a continuity roller which is capable of coming in contact with or leaving from the toner image receiving body 14*a*, a brush charging unit and a corona charging unit.

Obverse side images on the circumferential surface of the photoreceptor drum 10 are collectively transferred onto the upper side (obverse side) of recording sheet P by transfer unit 14*c* representing the first transfer means on which voltage with polarity opposite to that of toner (positive polarity in the present embodiment) is impressed. In this case, a reverse side image on the circumferential surface of the toner image receiving body 14*a* stays on it without being transferred onto recording sheet P. Next, reverse side images on the circumferential surface of the toner image receiving body 14*a* are collectively transferred onto the lower side (reverse side) of the recording sheet P by reverse side transfer unit 14*g* representing the second transfer means on which voltage with polarity opposite to that of toner (positive polarity in the present embodiment) is applied.

Since a toner image of each color is superimposed on the other, it is preferable for collective transfer that toner of an upper layer and toner of a lower layer both of the toner layer are charged with the same electrification quantity to be in the same polarity. Therefore, in the two-sided image forming wherein a color toner image formed on toner image receiving body 14*a* is subjected to polarity reversing conducted by corona charging, or a color toner image formed on photoreceptor drum 10 is subjected to polarity reversing conducted by corona charging, transfer is caused to be defective because toner of the lower layer is not charged sufficiently to be in the same polarity, which is not preferable.

It is preferable that reversal development is repeated on the photoreceptor drum 10, then color toner images with the same polarity thus formed to be superimposed are collectively transferred onto toner image receiving body 14*a* without being changed in terms of polarity, and then are collectively transferred onto recording sheet P without being changed in terms of polarity, because it contributes to improvement in transferability of reverse side image forming. Even for obverse side image forming, it is preferable that reversal development is repeated on the photoreceptor drum 10, and color toner images with the same polarity thus formed to be superimposed are collectively transferred onto recording sheet P without being changed in terms of polarity, because it contributes to improvement in transferability of obverse side image forming.

For the reasons mentioned above, a two-sided image forming method wherein the aforesaid method for forming an image on the obverse side and on the reverse side is used, and a color toner image is formed on the obverse side of a recording sheet through operation of the first transfer means and a color toner image is formed on the reverse side of a recording sheet through operation of the second transfer means is preferably used in color image forming.

When the reverse side transfer unit 14*g* representing the aforesaid second transfer means and sheet separation AC neutralizing unit 14*h* which will be stated later are united solidly, transfer-separating unit 141 serving as a transfer-separating means is structured.

Toner image receiving body 14*a* is an endless rubber belt having a thickness of 0.5–2.0 mm, and it is of a two-layer structure wherein a semiconductive base having a resistance value of $10^8$–$10^{12}$ Ω·cm made of silicone rubber or urethane rubber is coated on its outside with a fluorine coating with a thickness of 5–50 μm serving as a toner filming preventive layer. It is preferable that this layer is also semiconductive. It is also possible to use semiconductive polyester, polystyrene, polyethylene, polyethyleneterephthalate and polyimide each having a thickness of 0.1–0.5 mm, in place of the rubber belt base.

Recording sheet P having on its both sides color toner images formed is neutralized by sheet separation AC neutralizing unit 14*h* (hereinafter referred to also as a separation electrode) serving as a separating means for a recording sheet, then separated from toner image receiving body 14*a*, and conveyed to fixing unit 17 representing a fixing means composed of two rollers each having therein a heater. When heat and pressure are applied between fixing roller 17*a* and pressure roller 17*b*, toner sticking to the obverse side and toner sticking to the reverse side of the recording sheet P are fixed, and the recording sheet P which has been subjected to two-sided image recording is conveyed by sheet ejection roller 18 and reversed with its toner image of the reverse side image facing upward to be ejected onto a tray.

Between the fixing unit 17 and toner image receiving body 14*a*, there is provided conveyance section 150 with spurred wheels 152 by which the recording sheet P having on its both sides toner images formed is conveyed without being damaged on its toner images from the toner image receiving body 14*a* to the fixing unit 17.

Toner remaining on the toner image receiving body 14*a* after transferring is removed by blade 14 which is capable of coming in contact with or leaving from the toner image receiving body 14*a* provided on toner image receiving body cleaning unit 14*i* representing a cleaning means for the toner image receiving body. Toner remaining on photoreceptor drum 10 after transferring, on the other hand, arrives at cleaning unit 19 where the toner is scraped down into the cleaning unit 19 to be collected into an unillustrated waste toner container. The photoreceptor drum 10 from which the remaining toner has been removed by the cleaning unit 19 is subjected to uniform charging conducted by scorotron charging unit 11 for Y, to be ready for the succeeding image forming cycle.

Since the aforesaid method makes superimposed color toner images to be transferred collectively, doubling, toner scattering and frictional damage of a color image on the toner image receiving body are hardly caused, and excellent two-sided color image forming with less image deteriorations can be carried out.

Due to miniaturization of an apparatus caused by miniaturization of each exposure optical system 12 and of each developing unit 13 both are housed therein, a drum with a small outside diameter ranging from 50 mm to 100 mm can be used as photoreceptor drum 10, as stated above. When the outside diameter is not more than 50 mm, it is difficult to arrange each exposure optical system 12 in the photoreceptor drum 10, and it is also difficult to arrange four sets of scorotron charging unit 11 and four sets of developing unit 13 around the drum. When the outside diameter is not less than 10 mm, efficiency of a recording sheet to separate from the photoreceptor drum 10 is lowered and time required for image forming is increased to be more than needed. Further, there is caused a problem that positioning accuracy is also lowered depending on accuracy and deformation of the photoreceptor drum.

When the photoreceptor drum 10 has a small diameter, it is difficult to form a conveyance system for recording sheet P depending on the results of layout of exposure optical system 12 and developing unit 13, because of a short peripheral length. As explained above, however, the exposure optical systems 12 are miniaturized and are arranged in the photoreceptor drum 10, and developing units 13 are arranged around the photoreceptor drum 10 with their members arranged radially from the center of the photoreceptor drum 10, whereby developing units 13 for colors of Y, M, C and K can be arranged to be paired respectively with corresponding exposure optical systems 12 for colors of Y, M, C and K at locations above the horizontal line passing through the center axis of the photoreceptor drum 10, and a conveyance system for recording sheet P can be positioned almost horizontally to realize an apparatus wherein transfer of images onto recording sheet P and conveyance of the recording sheet P are ensured.

It is a matter of course that single-sided copying by means of photoreceptor drum 10 representing an image forming body or toner image receiving body 14*a* can be carried out in the color image forming apparatus mentioned above.

Incidentally, process unit 300 is structured when photoreceptor drum 10 and exposure optical system 12 are united solidly, and supporting shaft 30 supporting photoreceptor drum 10 and exposure optical system 12 is fixed on side plates 301 and 302 constituting a casing of process unit 300 under the state that the exposure optical systems 12 are positioned, and when developing unit 13 for each color united solidly with scorotron charging unit 11 and cleaning unit 19 are mounted respectively at prescribed positions on side plates 301 and 302. Further, the color image forming apparatus stated above is made to be of a clamshell type wherein the apparatus is divided into upper shell 101 and lower shell 102 along a conveyance path indicated with one-dot chain lines in FIG. 1 for recording sheet P formed by both photoreceptor drum 10 and toner image receiving body 14*a*. When the recording sheet P is jammed, the upper shell 101 is opened for jam clearance.

As shown in FIG. 7, when the upper shell 101 is opened around shaft 101*b* serving as a fulcrum, the process unit 300 mounted on the upper shell 101 is also opened, and it is provided so that it can be mounted on or dismounted from the upper shell 101 through opening 101*a*.

In the case of clearance of jamming recording sheet P, when the upper shell 101 is in its opened state, transfer-separating unit 141 is positioned either on the part of photoreceptor drum 10 provided on the upper shell 101 shown in FIG. 7, or on the part of fixing unit 17 provided on the lower shell 102 (not shown), while when the upper shell 101 is in its closed state, transfer-separating unit 141 is positioned to be close to and to face toner image receiving body 14*a* shown in FIG. 1.

In accordance with FIGS. 4–6, conveyance section 150 provided with spurred wheels 152 is provided under the recording sheet conveyance plane of toner image receiving body 14*a* between the toner image receiving body 14*a* and fixing unit 17 (fixed position of conveyance section 150), and recording sheet P separated from the toner image receiving body 14*a* is conveyed through the conveyance section 150 to fixing unit 17 on which fixing roller 17*a* and pressure roller 17*b* are provided vertically.

The conveyance section 150 is composed of casing 151, plural spurred wheels 152 mounted on the casing 151, and wire 153 trained about the casing 151. On top surface 151*d* of the casing 151, there is provided square opening 151*a* which is further provided on its both ends with grooves 151*b* and 151*c*, and supporting shaft 152*a* passing through the center of spurred wheel 152 is engaged with the grooves 151*b* and 151*c* located at both ends of the square opening 151*a*, thus the spurred wheel 152 is mounted rotatably on the casing 151.

Wire 153 serving as a guide member is trained about the casing 151 by the use of pins 154, in which the wire 153 is trained above supporting shaft 152*a* representing the rotary center of the spurred wheel 152 owing to projections 151*e* and 151*f* on the casing 151.

Spurred wheel 152 is preferably one having a thickness ranging from 0.05 mm to 0.5 mm and an outside diameter ranging from 5 mm to 25 mm, and it is composed of a hexagonal plate member having an outside diameter of 10 mm obtained by etching a metal plate such as a stainless steel plate or a copper plate having a thickness of 0.2 mm, for example, and providing sharp edge portion 152*b* on each tip of the metal plate. This metal plate is grounded through a resistor of $10^{10}$–$10^{14}$ Ω. The basis for the spurred wheels 152 to be grounded through a metal plate and through a highly resistant object or by the use of a highly resistant member is to prevent, through neutralizing, toner adhesion caused by charge accumulation on the spurred wheels 152 or by image force because toner and a recording sheet have charges, and thereby to prevent disturbance of toner images.

When the recording sheet P onto which toner images have been transferred conveyed to the conveyance section 150, wire 153 trained to be above the supporting shaft 152*a* representing a rotary center of spurred wheel 152 picks up the leading edge of the recording sheet P, whereby a toner image is conveyed, without being rubbed, to the spurred wheels 152 where the spurred wheels 152 are driven to rotate with their sharp edge portions 152*b* coming into contact with or piercing into the recording sheet P, so that the recording sheet P is conveyed to the fixing unit 17. The wire 153 serving as a guide member trained to be above the supporting shaft 152*a* representing a rotary center of spurred wheel 152 prevents the trailing edge of the recording sheet P from falling and thereby the toner image is not rubbed. Even in the case where the recording sheet P having on its lower surface toner images formed is conveyed, a toner image can be conveyed without being rubbed.

Spurred wheels 152 are provided as group H1 of spurred wheels and group H2 of spurred wheels in each of which plural spurred wheels are arranged in parallel in the longitudinal direction of the fixing unit 17.

Incidentally, the conveyance section 150 provided with spurred wheels 152 may also be positioned above the recording sheet conveyance plane of toner image receiving body 14*a*, with the spurred wheels 152 facing downward.

Arrangement of a transfer-separating means on the part of an image forming body will be explained, referring to FIGS. 8(A), 8(B), 9, 10 and FIG. 7. Each of FIGS. 8(A) and 8(B) is a diagram showing the first example of the arrangement of the transfer-separating means on the part of the image forming body, and FIG. 8(A) is a diagram showing how the transfer-separating means is moved from the image forming body to an intermediate transfer body, while FIG. 8(B) is a diagram showing the mechanism to move the transfer-separating means from the image forming body to the intermediate transfer body. FIG. 9 is a diagram showing the second example of the arrangement of the transfer-separating means on the part of the image forming body, while FIG. 10 is a diagram showing the third example of the arrangement of the transfer-separating means on the part of the image forming body.

In the case of clearance of jamming recording sheet P, when the upper shell 101 is in its opened state as illustrated in FIG. 7, transfer-separating means 141 is positioned with its discharge surface 141*a* facing downward on the part of photoreceptor drum 10 provided on the upper shell 101, as shown in FIG. 8(A), while when the upper shell 101 is in its closed state, the transfer-separating means 141 is moved so that its discharge surface 141*a* is positioned to be close to the toner image receiving body 14*a* to face it.

When the upper shell 101 is in its opened state, lever 502 which is attached on the upper shell 101 to be rotatable with supporting shaft 503 serving as a fulcrum is rotated counterclockwise by spring S1 as shown with solid lines in FIG. 8(B) until it hits stopper 504 provided on the upper shell 101. Mount 501 on which transfer-separating unit 141 is attached is mounted at the tip of lever 502 to be rotatable relatively to the lever 502 around shaft 501*a*, and the transfer-separating unit 141 is set at the lower portion on the part of photoreceptor drum 10 provided on the upper shell 101 under the condition that the lever 502 is in contact with stopper 504.

As the upper shell 101 is closed, end portion 502*a* opposite to the side where transfer-separating unit 141 is attached on the lever 502 is pushed up by the lower shell 102 to be moved in the direction shown with an arrow mark in FIG. 8(B), thus, the lever 502 is rotated around the supporting shaft 503 to the position shown with dotted lines in FIG. 8 (B). In this case, due to a movement of both the shaft 501*a* attached on the mount 501 and pin 501*b* on the side of the mount 501 guided by guide groove 505*a* provided on plate-shaped guide plate 505 which is attached on the upper shell 101, the transfer-separating unit 141 attached on the mount 501 is moved from the lower portion of the upper shell 101 to the position where discharge surface 141*a* of the transfer-separating unit 141 faces the toner image receiving body 14*a* in the neighborhood thereof, to be set.

In the above-mentioned explanation, both the lever 502 on which the transfer-separating unit 141 is attached and guide plate 505 provided with guide groove 505*a* which guides a movement of the transfer-separating unit 141 are mounted on the upper shell 101. However, it is also possible to employ an arrangement wherein the lever 502 and the guide plate 505 are mounted respectively on side plate 301 and side plate 302, for example, of process unit 300 explained in FIG. 1 and FIG. 3, and the transfer-separating unit 141 attached on the lever 502 that is pushed up by the lower shell 102 is fixed on the process unit 300 solidly so that the transfer-separating unit 141 may move between the lower portion of the process unit 300 and the position facing the toner image receiving body 14*a*.

It is further possible to employ an arrangement wherein a discharge electrode of the transfer-separating unit 141 is protected by arranging so that the discharge surface 141*a* of the transfer-separating unit 141 to be set on the lower part of the upper shell 101 is covered by protective cover 551 which is moved by an unillustrated link mechanism operating when the upper shell 101 is opened, as shown in FIG. 9. As the upper shell 101 is closed, the protective cover 551 is opened, and then the transfer-separating unit 141 is moved in the same way as that explained in FIG. 8(B).

It is also possible to arrange so that the transfer-separating unit 141 to be set on the lower part of the upper shell 101 is moved down to the lower side of the upper shell 101, facing the upper shell 101 with discharge surface 141*a* facing upward to protect the discharge electrode, as shown in FIG. 10, when the upper shell 101 is opened. The movement is conducted by changing a shape of the guide groove 505*a* of the guide plate 505 explained in FIG. 8(B).

Even in the case of FIG. 9 and FIG. 10, the transfer-separating unit 141 can also be provided on the process unit 300.

Owing to the aforegoing, the transfer-separating means does not obstruct to cause jam clearance to be easy, and damage of the transfer-separating means in the course of jam clearance can be prevented. In particular, damage of a discharge electrode of the transfer-separating means can be prevented.

Figure 11:
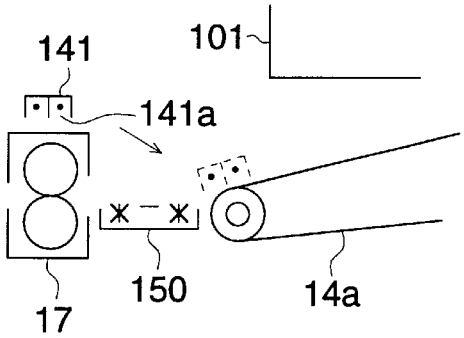
Figure 11:
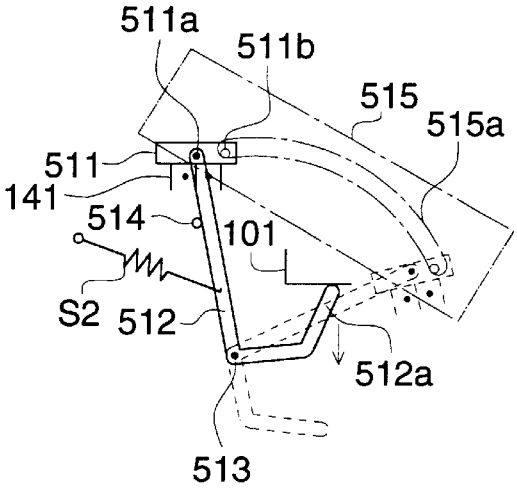

Arrangement of the transfer-separating means on the part of a fixing means will be explained as follows, referring to FIGS. 11(A), 11(B), 12 and 7. Each of FIGS. 11(A) and 11 (B) is a diagram showing the first example of the arrangement of the transfer-separating means on the part of a fixing means, FIG. 11(A) is a diagram showing how the transfer-separating means is moved from the side on the part of the fixing means to an intermediate transfer body, FIG. 11(B) is a diagram showing the moving mechanism by which the transfer-separating means is moved from the side on the part of the fixing means to the intermediate transfer body, and FIG. 12 is a diagram showing the second example of the arrangement of the transfer-separating means on the part of a fixing means.

Lever 512 on which transfer-separating unit 141 is mounted and guide plate 515 provided with guide groove 515*a* which guides a movement of the transfer-separating unit 141 are attached on the lower shell 102.

In the case of clearance of jamming recording sheet P, when the upper shell 101 is in its opened state as explained in FIG. 7, the transfer-separating unit 141 is positioned, with its discharge surface 141*a* facing downward, to face the upper surface of fixing unit 17 which is provided on the lower shell 102 as shown in FIG. 11(A), while when the upper shell 101 is in its closed state, the transfer-separating unit 141 is moved so that the discharge surface 141*a* can be set to the position where the discharge surface 141*a* can face the toner image receiving body 14*a* in the neighborhood thereof.

When the upper shell 101 is in its opened state, lever 512 which is attached on the lower shell 102 to be rotatable with supporting shaft 513 serving as a fulcrum is rotated counterclockwise by spring S2 as shown with solid lines in FIG. 11(B) until it hits stopper 514 provided on the lower shell 102. Mount 511 on which transfer-separating unit 141 is attached is mounted at the tip of lever 512 to be rotatable relatively to the lever 512 around shaft 511*a*, and the transfer-separating unit 141 is set at the upper portion on the part of fixing unit 17 provided on the lower shell 102 under the condition that the lever 512 is in contact with stopper 514.

As the upper shell 101 is closed, end portion 512*a* opposite to the side where transfer-separating unit 141 is attached on the lever 512 is pushed down by the upper shell 101 to be moved in the direction shown with an arrow mark in FIG. 11(B), thus, the lever 512 is rotated around the supporting shaft 513 to the position shown with dotted lines in FIG. 11(B). In this case, due to a movement of both the shaft 511*a* attached on the mount 511 and pin 511*b* on the side of the mount 511 guided by guide groove 515*a* provided on plate-shaped guide plate 515 which is attached on the lower shell 102, the transfer-separating unit 141 attached on the mount 511 is set from the upper portion of the fixing unit 17 to the position where the discharge surface 141*a* of the transfer-separating unit 141 can face the toner image receiving body 14*a* in the neighborhood thereof.

It is further possible to employ an arrangement wherein, when the upper shell 101 is in its opened state, transfer-separating unit 141 to be set on the upper side of fixing unit 17 on the part of toner image receiving body 14*a* is provided, and a discharge electrode of the transfer-separating unit 141 is protected by arranging so that the discharge surface 141*a* of the transfer-separating unit 141 is covered by protective cover 552 moved by an unillustrated link mechanism which operates when the upper shell 101 is opened, as shown in FIG. 12. As the upper shell 101 is closed, the protective cover 552 is opened, and then the transfer-separating unit 141 is moved in the same way as that explained in FIG. 11.

In the aforegoing, the lever 512 on which the transfer-separating unit 141 is attached and the guide plate 515 provided with guide groove 515*a* which guides a movement of the transfer-separating unit 141 can also be mounted solidly on the side plate of the fixing unit 17 so that the transfer-separating unit 141 may be moved.

Owing to the aforegoing, the transfer-separating means does not obstruct to cause jam clearance to be easy, and damage of the transfer-separating means in the course of jam clearance can be prevented. In particular, damage of a discharge electrode of the transfer-separating means can be prevented.

Arrangement of the conveyance section will be explained as follows, referring to FIG. 13(A)–FIG. 16 and FIG. 7. Each of FIGS. 13(A) and 13(B) is a diagram showing the first example of the arrangement of the conveyance section, FIG. 13 (A) is a diagram showing how the conveyance section is moved from the intermediate transfer body, FIG. 13(B) is a diagram showing the moving mechanism by which the conveyance section is moved from the intermediate transfer body, FIG. 14 is a diagram showing the second example of the arrangement of the conveyance section, FIG. 15 is a diagram showing the third example of the arrangement of the conveyance section, and FIG. 16 is a diagram showing the fourth example of the arrangement of the conveyance section.

Lever 522 on which transfer-separating unit 141 is mounted and guide plate 525 provided thereon with a guide groove 525*a* are attached on the lower shell 102.

In the case of clearance of jamming recording sheet P, when the upper shell 101 explained in FIG. 7 is in its opened state, the conveyance section 150 is positioned with its spurred wheels facing upward to face the lower side of toner image receiving body 14*a* which is provided on the lower shell 102, so that tips of the spurred wheels 152 may not be damaged or they may not stick in hands, as shown in FIG. 13(A), while when the upper shell 101 is in its closed state, the conveyance section 150 is moved from the lower side of the toner image receiving body 14*a* to be set at a fixed position explained in FIG. 4 which is between fixing unit 17 and the toner image receiving body 14*a*, with its spurred wheels facing upward.

When the upper shell 101 is in its opened state, lever 522 which is attached on the lower shell 102 to be rotatable with supporting shaft 523 serving as a fulcrum is rotated clockwise by spring S3 as shown with solid lines in FIG. 13 (B) until it hits stopper 524 provided on the lower shell 102. Mount 521 on which conveyance section 150 having spurred wheels 152 is attached is mounted at the tip of lever 522 to be rotatable relatively to the lever 522 around shaft 521*a*, and the conveyance section 150 is set at the lower portion of toner image receiving body 14*a* provided on the lower shell 102 under the condition that the lever 522 is in contact with stopper 524.

As the upper shell 101 is closed, end portion 522*a* opposite to the side where conveyance section 150 is attached on the lever 522 is pushed down by the upper shell 101 to be moved in the direction shown with an arrow mark in FIG. 13(B), thus, the lever 522 is rotated around the supporting shaft 523 to the position shown with dotted lines in FIG. 13(B). In this case, due to a movement of both the shaft 521*a* attached on mount 521 and pin 521*b* on the side of the mount 521 guided by guide groove 525*a* provided on plate-shaped guide plate 525 which is attached on the lower shell 102, the conveyance section 150 attached on the mount 521 is set from the lower side of the toner image receiving body 14*a* to a fixed position between fixing unit 17 and the toner image receiving body 14*a*, with its spurred wheels facing upward.

It is also possible to employ an arrangement wherein, when the upper shell 101 is in its opened state, the conveyance section 150 is positioned with its spurred wheels facing upward to face the lower side of fixing unit 17 which is provided on the lower shell 102, so that tips of the spurred wheels 152 may not be damaged or they may not stick in hands, as shown in FIG. 14, while when the upper shell 101 is in its closed state, the conveyance section 150 is moved from the lower side of the toner image receiving body 14*a* to be set at a fixed position between the fixing unit 17 and the toner image receiving body 14*a*, with its spurred wheels facing upward.

It is further possible to employ an arrangement wherein, when the upper shell 101 is in its opened state, the conveyance section 150 is positioned at the lower portion on the side closer to the toner image receiving body 14*a* of fixing unit 17 provided on the lower shell 102 so that tips of the spurred wheels 152 may not be damaged or they may not stick in hands, as shown in FIG. 14, while when the upper shell 101 is in its closed state, the conveyance section 150 rotates and is moved from the lower side of the toner image receiving body 14*a* to be set at a fixed position between the fixing unit 17 and the toner image receiving body 14*a*, with its spurred wheels facing upward.

It is further possible to employ an arrangement wherein, when the upper shell 101 is in its opened state, conveyance section 150 is provided under the fixed position between fixing unit 17 and toner image receiving body 14*a*, and spurred wheels 152 of the conveyance section 150 are protected by arranging so that the spurred wheels 152 of the conveyance section 150 may be covered by protective cover 553 moved by an unillustrated link mechanism which operates when the upper shell 101 is opened, as shown in FIG. 16. As the upper shell 101 is closed, the protective cover 553 is moved from the top surface of the conveyance section 150 and then the conveyance section 150 is set at the fixed position between the fixing unit 17 moved to the upper portion and the toner image receiving body 14*a*.

Owing to the foregoing, damage of spurred wheels and an injury caused by spurred wheels both taking place in the course of jam clearance can be prevented.

A distance between spurred wheels and a guide member both provided on a conveyance section will be explained as follows, referring to FIGS. 17, 18 and 7. FIG. 17 is a diagram showing the first example of a distance between spurred wheels and a guide member both provided on a conveyance section, and FIG. 18 is a diagram showing the second example of a distance between spurred wheels and a guide member both provided on a conveyance section.

In FIG. 17, conveyance section 250 is composed of casing 251*a* and casing 251*b* which is engaged with an external wall of the casing 251*a*, and the casing 251*a* and the casing 251*b* are capable of moving vertically. Wire 153 serving as a guide member is trained about the casing 251*b* in the same manner as that explained in FIGS. 4 and 5, while spurred wheels 152 are provided on the casing 251*a* in the same manner as that explained in FIGS. 4 to 6.

In the case of clearance of jamming recording sheet P, when the upper shell 101 is in its opened state explained in FIG. 7, the casing 251*a* provided with spurred wheels 152 is set to the lower position shown with solid lines in FIG. 17 and the casing 251*b* on which the wire 153 is trained is set to the upper position, whereby the wire 153 is positioned at the upper portion to be away from sharp edge portion 152*b* of the spurred wheel 152, preventing the sharp edge portion 152*b* from touching hands.

As the upper shell 101 is closed, casing 251*a* is moved upward and casing 251*b* is moved downward both to the position shown with a dotted line in FIG. 17 by an unillustrated link mechanism, and whereby spurred wheels 152 provided on the casing 251*a* are moved upward and wire 153 provided on the casing 251*b* is moved downward both to the position shown with a dotted line in FIG. 17, and the wire 153 is trained at the position which is lower than the sharp edge portion 152*b* and is higher than supporting shaft 152*a* serving as the rotary center of the spurred wheel 152 to be set at the fixed position.

It is also possible to arrange so that the casing 251*b* provided with wire 153 is fixed at the fixed position, and the casing 251*a* provided thereon with spurred wheels 152 is made to be capable of moving downward, so that the sharp edge portion 152*b* of the spurred wheel 152 may be away from the wire 153 downward, when the upper shell 101 is opened, as shown in FIG. 18.

It is further possible to arrange so that the casing 251*a* is fixed and the casing 251*b* is made capable of moving so that the wire 153 may be positioned to be away from the sharp edge portion 152*b* of the spurred wheel 152 when the upper shell 101 is opened. In this way, spurred wheels 152 and wire 153 are made to move relative to each other so that the wire 153 and the sharp edge portion 152*b* of the spurred wheel 152 are made to be away from each other.

Owing to the foregoing, damage of spurred wheels in the course of jam clearance can be prevented, and in particular, an injury to an operator's hands caused by spurred wheels in the course of jam clearance can be prevented. It is further preferable that retraction of transfer-separating unit 141 from the sheet feeding path and retraction of conveyance section 150 from the sheet feeding path are conducted simultaneously. Owing to this, transfer-separating unit 141 and conveyance section 150 both of which are located to be close to recording sheets remaining after jamming, are retracted from the recording sheets, making the space to be greater, which makes it easy to take out the recording sheets.

To make jam clearance to be more easy, a clamshell configuration (halved main body) is preferable.

The invention prevents the transfer-separating means from being obstructed and thereby makes jam clearance easy, and prevents damage of the transfer-separating means in the course of jam clearance. In particular, damage of a discharge electrode of the transfer-separating means can be prevented.

Further, damage of spurred wheels and an injury caused by spurred wheels can be prevented.

What is claimed is:

1. An image forming apparatus comprising:

(a) an image forming body for carrying thereon a toner image;

(b) a belt-shaped intermediate transfer body for carrying thereon the toner image transferred from the image forming body;

(c) first transfer means for transferring a toner image carried by the image forming body onto an obverse side of a transfer member conveyed by the intermediate transfer body;

(d) second transfer means for transferring the toner image carried on the intermediate transfer body onto a reverse side of the transfer member;

(e) fixing means for fixing the toner images transferred on both sides of the transfer member which is separated from the intermediate transfer body; and (f) a conveyor portion having spurred wheels provided between the intermediate transfer body and the fixing means for conveying the transfer member to the fixing means, wherein the apparatus has a structure including two frames which can be opened, and wherein when the frames are closed, the image forming body is set to a first position adjacent to and facing the intermediate transfer body and the second transfer means is set to a second position adjacent to the intermediate transfer body and the conveyor portion, and when the frames are opened, the image forming body is apart from the first position and the second transfer means is apart from the second position.

2. The image forming apparatus of claim 1, further comprising:

a process unit in which the image forming body, charging means disposed on a periphery of the image forming body for charging the image forming body, imagewise exposure means disposed inside the image forming body for imagewise exposing the charged image forming body to form a latent image, developing means disposed on the periphery of the image forming body for developing the latent image to form a toner image, and a cleaning device for cleaning a circumferential surface of the image forming body, are integrally formed as a unit, and wherein said second transfer means is integrally provided on the process unit.

3. An image forming apparatus comprising:

(a) an image forming body for carrying thereon a toner image;

(b) a belt-shaped intermediate transfer body for carrying thereon the toner image transferred from the image forming body;

(c) first transfer means for transferring a toner image carried by the image forming body onto an obverse side of a transfer member conveyed by the intermediate transfer body;

(d) second transfer means for transferring the toner image carried on the intermediate transfer body onto a reverse side of the transfer member; and (e) fixing means for fixing the toner images transferred on both sides of the transfer member which is separated from the intermediate transfer body;

wherein the apparatus has a structure including two frames which can be opened, wherein when the frames are closed, the image forming body is set to a first position adjacent to and facing the intermediate transfer body and the second transfer means is set to a second position adjacent to and facing the intermediate transfer body, and when the frames are opened, the image forming body is apart from the first position and the second transfer means is apart from the second position, and wherein said second transfer means is integrally provided on said fixing means.

4. An image forming apparatus comprising:

(a) an image forming body for carrying thereon a toner image;

(b) a belt-shaped intermediate transfer body for carrying thereon the toner image transferred from the image forming body;

(c) first transfer means for transferring a toner image carried by the image forming body onto an obverse side of a transfer member conveyed by the intermediate transfer body;

(d) second transfer means for transferring the toner image carried on the intermediate transfer body onto a reverse side of the transfer member; and (e) fixing means for fixing the toner images transferred on both sides of the transfer member which is separated from the intermediate transfer body;

wherein the apparatus has a structure including two frames which can be opened, wherein when the frames are closed, the image forming body is set to a first position adjacent to and facing the intermediate transfer body and the second transfer means is set to a second position adjacent to and facing the intermediate transfer body, and when the frames are opened, the image forming body is apart from the first position and the second transfer means is apart from the second position, and wherein when the frames are opened, a surface of a discharging portion of said second transfer means is protected by a protective cover movable in association with an opening movement of the frames.

5. An image forming apparatus comprising:

(a) an image forming body for carrying thereon a toner image;

(b) a belt-shaped intermediate transfer body for carrying thereon the toner image transferred from the image forming body;

(c) first transfer means for transferring a toner image carried by the image forming body onto an obverse side of a transfer member conveyed by the intermediate transfer body;

(d) second transfer means for transferring the toner image carried on the intermediate transfer body onto a reverse side of the transfer member;

(e) fixing means for fixing the toner images transferred on both sides of the transfer member which is separated from the intermediate transfer body; and (f) a conveyor portion having spurred wheels provided between the intermediate transfer body and the fixing means for conveying the transfer member to the fixing means, wherein the apparatus has a structure including two frames which can be opened, and wherein when the frames are closed, the conveyor portion is set to a predetermined position between the intermediate transfer body and the fixing means, and when the frames are opened, the conveyor portion is apart from the predetermined position.

6. The image forming apparatus of claim 5, wherein the two frames includes an upper frame on which the image forming body is provided, and a lower frame on which the intermediate transfer body and the fixing means are provided, wherein the upper frame can be opened from the lower frame along a feeding path of the transfer member formed by the image forming body and the intermediate transfer body, and wherein when the upper frame is opened, the conveyor portion is positioned on a side of the intermediate transfer body or the fixing means.

7. The image forming apparatus of claim 6, wherein said conveyor portion is integrally provided on said intermediate transfer body.

8. The image forming apparatus of claim 6, wherein said conveyor portion is integrally provided on said fixing means.

9. The image forming apparatus of claim 6, wherein when the upper frame is opened, the spurred wheels of said conveyor portion are protected by a protective cover movable in association with an opening movement of the upper frame.

10. The image forming apparatus of claim 6, wherein when the upper frame is opened, the spurred wheels of said conveyor portion are receded from a position where the spurred wheels are in contact with the transfer member to convey the transfer member.

11. The image forming apparatus of claim 5, wherein the frames can be opened along a feeding path of the transfer member formed by the image forming body and the intermediate transfer body, and wherein when the frames are opened, the conveyor portion and the second transfer means are moved to be receded from the feeding path of the transfer member in a direction opposite to each other.

12. The image forming apparatus of claim 11, further comprising a guiding member provided on an upper portion of the conveyor portion for guiding the transfer member, wherein the two frames includes an upper frame on which the image forming body is provided, and a lower frame on which the intermediate transfer body and the fixing means are provided, and wherein when the upper frame is opened, the spurred wheels provided on the conveyor portion and the guide member are relatively moved so as to be receded from each other.

13. An image forming apparatus comprising:

(a) an image forming body for carrying thereon a toner image;

(b) a belt-shaped intermediate transfer body for carrying thereon the toner image transferred from the image forming body;

(c) first transfer means for transferring a toner image carried by the image forming body onto an obverse side of a transfer member conveyed by the intermediate transfer body;

(d) second transfer means for transferring the toner image carried on the intermediate transfer body onto a reverse side of the transfer member;

(e) fixing means for fixing the toner images transferred on both sides of the transfer member which is separated from the intermediate transfer body;

(f) a conveyor portion having spurred wheels provided between the intermediate transfer body and the fixing means for conveying the transfer member to the fixing means; and (g) means for enabling the the conveyor portion and the second transfer means to be apart from the transfer member in a direction opposite to each other.

14. The image forming apparatus of claim 13, wherein the apparatus has a structure including two frames which can be opened along a feeding path of the transfer member formed by the image forming body and the intermediate transfer body.

* * * * *